United States Patent [19]

Shollenbarger

[11] Patent Number: 4,485,727

[45] Date of Patent: Dec. 4, 1984

[54] PRESSURE PILOT SWITCH POINT DEVICE

[75] Inventor: David W. Shollenbarger, Marshalltown, Iowa

[73] Assignee: Fisher Controls International, Inc., Marshalltown, Iowa

[21] Appl. No.: 459,173

[22] Filed: Jan. 19, 1983

[51] Int. Cl.[3] ..... F15B 15/24

[52] U.S. Cl. ..... 92/13.2; 92/13.5; 92/91; 73/732; 200/81.8; 74/89.15

[58] Field of Search ..... 92/89, 90, 91, 92, 5 R, 92/13.2, 13.5; 200/81.8, 153 T; 73/711, 732, 733, 734, 735, 736, 737, 738, 739, 740, 741; 74/89.15

[56] References Cited

U.S. PATENT DOCUMENTS

| | | | |
|---|---|---|---|
| 2,557,929 | 6/1951 | Baak | 200/81.8 |
| 2,803,718 | 8/1957 | Bloom et al. | 200/153 T |
| 2,964,601 | 12/1960 | Stockwell | 200/153 T |
| 3,569,647 | 3/1971 | Kiwalle | 73/739 |
| 3,952,611 | 4/1976 | Cumming | 200/153 T |
| 4,167,896 | 9/1979 | Clements | 92/13.2 |
| 4,206,912 | 6/1980 | Pearson | 200/153 T X |
| 4,323,741 | 4/1982 | Krohn | 92/91 X |

OTHER PUBLICATIONS

Liquid Level Lectronics, Inc. Brochure, "Pneumatic Pressure Pilot".

Dyna-Trol Inc. Brochure, "Pressure Sentry".

Baker CAC Inc. Brochure, "Product Bulletin Type DEP Direct Dial Pilot", Feb. 1, 1979.

Automation USA Brochure, "Wellcheck High-Low Pressure Sensors".

Fisher Controls, 4100Z Series Pressure Controller, Nov. 1976, Bulletin 34.3:4100Z.

Barber Machinery Co. Limited Brochure, "Presco Pilot", Bulletin 660.

Jim Ellett; "New Pressure Control Pilot Solves A Pollution Problem".

Oil & Gas Journal, "Equipment/Literature", Dec. 17, 1979.

Controlonics Inc. Brochure, "Model PSHL Pressure Pilot".

Dixie Instrument Corp. Brochure, "BAPP Blind Automated Pressure Pilot".

Control Pilots Inc. Brochure, "JO PILOT".

ANOT Controls Corporation Brochure, "ANOT Model 1672 Pressure Valves".

Controlonics Inc. Brochure, "Model PSHL-P Panel Mounted Pressure Pilot With Pneumatic Set Points".

Ametek Controls Division Brochure; "Model 47 Low--Bleed Controllers and Transmitter".

*Primary Examiner*—Robert E. Garrett

*Assistant Examiner*—Timothy E. Nauman

*Attorney, Agent, or Firm*—Dale A. Kubly

[57] ABSTRACT

An improved switch point setting device for fluid process sensors monitoring a process pressure, including a cylindrical housing, an elongated threaded shaft rotatably mounted in the housing, and a movable post member with a threaded base portion threadably mounted on the threaded shaft within the housing and a dog-leg post portion extending from the housing to form a pressure set point. A coil spring within the housing biases the threaded base portion in positive threaded engagement with the threaded shaft. An O-ring provided around the base portion on each side of the post portion enables threadable movement of the base portion during set point adjustment while otherwise maintaining the base portion reliably in position.

7 Claims, 3 Drawing Figures

PRESSURE PILOT SWITCH POINT DEVICE

This invention relates to fluid pressure sensing devices and in particular to such devices for monitoring pressure and detecting conditions wherein the pressure extends beyond a predetermined pressure, that is, either by extending above a high pressure limit or, by extending below a low pressure limit.

BACKGROUND OF THE INVENTION

Various types of fluid pressure sensing devices are currently available for use as safety devices in the monitoring and sensing of process pressures such as at oil and gas wells, petrochemical sources, and associated production and processing installations. The United States Government has specified certain performance and safety requirements for such pressure sensors, known in the trade as "pressure pilots". The required sensors or pilots must be highly accurate and extremely reliable in order to properly protect production equipment, operating personnel and the environment at on-shore oil and gas drilling and processing plants as well as such off-shore installations.

Thus, presently available pressure sensors or pressure pilots are designed to automatically activate or trip safety shutdown systems when the sensed process pressure either extends above a previously set high pressure point or extends below a low pressure set point. When the process pressure returns to the desired safe range within the high and low pressure limits, the pressure sensor should be capable of automatic reset.

It is desirable that a pressure sensor be capable of accurate set point tripping under repeated conditions (this function being known as "set point repeatability"), and once tripped, should have the capability to reset within a fairly narrow zone (commonly known as "trip-to-reset"). The capability of providing high-only, low-only, or high and low pressure set points or pressure limits is desirable.

Generally, presently available pressure sensors include a Bourdon tube for sensing pressure changes, adjustable switch point means for setting a pressure set point and responding to movements in the Bourdon tube caused by sensed pressure changes, with indicating means providing an indication that the pressure set point established by the adjustable switch point means has been reached. In such units, the switch point device must be able to be readily set while also be capable of maintaining a reliable set point, even when subject to vibrations.

SUMMARY OF THE INVENTION

In accordance with the principles of the present invention, there is provided a highly reliable and readily adjustable switch point device for a pressure sensor. A threaded shaft is provided rotatably mounted within an elongated cylindrical housing. A movable post member is threadably mounted to the shaft and includes a base portion within the housing and a dog-leg post portion extending through a slot in the housing. Biasing means, such as a spring mounted within the housing urges the base portion into positive threadable engagement, thereby always loading or biasing the base member in one direction on the shaft. Rotating the threaded shaft readily adjusts the post portion to the desired pressure set point. High manufacturing tolerances are not necessary since the post portion is always biased in the same direction.

Resilient means, such as a pair of O-rings are mounted on the base portion outer surface and resiliently engage the housing inner surface. The resilient O-rings tend to maintain the base portion in the set position within the housing and thereby enable a reliable pressure set point to be held. Furthermore, the resilient O-rings act to absorb any shock and vibration which would otherwise tend to move the position of the set point and thus could undesirably trip the pressure sensor unit.

BRIEF DESCRIPTION OF THE DRAWINGS

Reference may be made to the following description taken in conjunction with the accompanying drawings and which like reference numerals identify like elements in the several figures, and in which.

DETAILED DESCRIPTION

Figure 1:
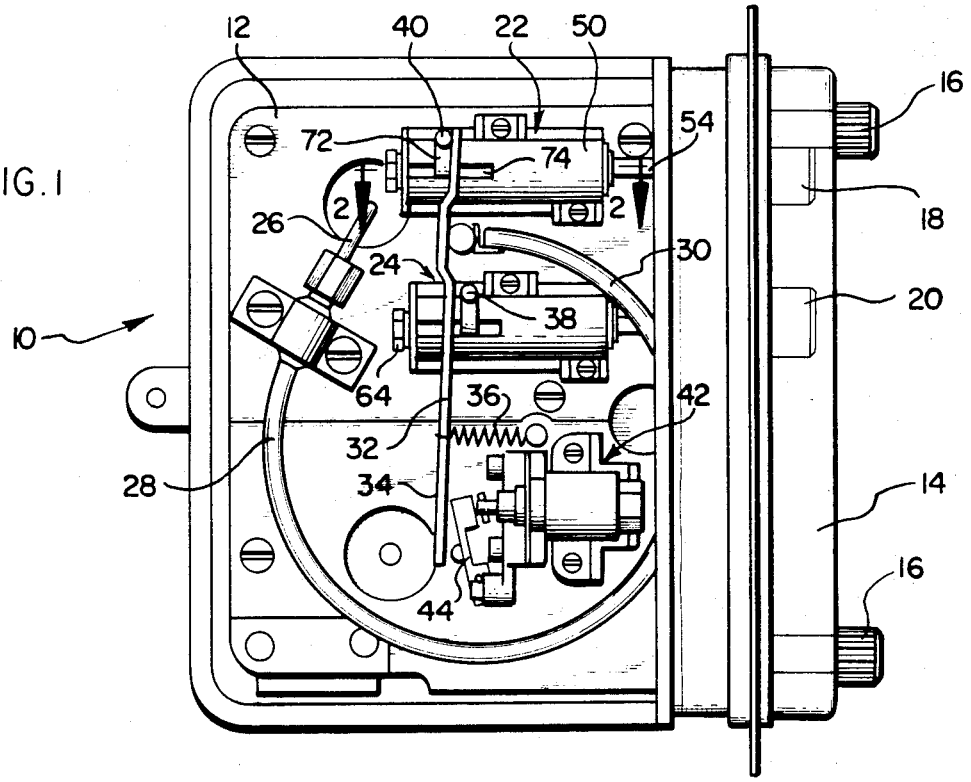
FIG. 1 is an elevational view showing a pressure sensor or pressure pilot containing a pair of switch point devices in accordance with the principles of the present invention.

FIG. 1 illustrates a pressure sensor or pressure pilot 10 which includes a cabinet or frame 12 having a front cover 14 and a side cover (not shown) which has been removed in the view of FIG. 1. Captured screws 16 are provided for removing the front cover and similar captured screws may be provided for removing the side cover. Knobs 18, 20 are respectively provided for presetting the desired low and high pressure set points of associated switch point devices 22, 24.

Tubing 26 is coupled at one end (not shown) to the pressure to be sensed, hereinafter termed the "process pressure". It is to be understood that the process pressure may be any one of a variety of fluid pressures to be sensed, i.e., gas or liquid, depending upon whether the pressure sensor is to be mounted at an oil or gas drilling cite, a petrochemical processing or production installation, an off-shore facility, etc. The other end of tubing 26 is coupled to a Bourdon tube 28 having a moving end 30 pivotally mounted to a lever arm 32. One end 34 of the lever arm is biased by means of a spring 36 to reduce movement of end 34 during vibration.

As can be seen most clearly from FIG. 1, an increasing process pressure is sensed by the Bourdon tube to move tube end 30 and lever arm 32 towards a high-pressure set point 38 on switch point device 24; whereas a decreasing process pressure would move the lever arm towards a low pressure set point 40 on switch point device 22. A fluid operated block and bleed relay 42 is suitably mounted to frame 12 and includes a beam 44 normally urged by spring means to the position shown in FIG. 1 when the process pressure has reached either of the switch points 38 or 40. The relay beam is pivotally mounted at one end and includes a cap at the other beam end for capping the relay. When the process pressure is within the safe range, i.e., between the low and high pressure set points, lever arm 34 is engaged against beam 44 thereby capping relay 42.

Relay 42 is normally pneumatically operated, however, if it is so desired, the relay may be operated by a liquid pressure. It is to be understood that suitable inlet and outlet pressure lines are coupled to relay 42 such that pressure level changes are indicated by the relay upon capping and uncapping of the relay in response to the sensed process pressure. Further details as to the structure and operation of the pressure sensor shown in FIG. 1 (except for the details of switch point devices 22, 24) may be obtained with reference to a co-pending application of J. W. Duffy, R. A. Funke, and D. W. Shollenbarger, which application is assigned to the same assignee as herein.

Figure 2:
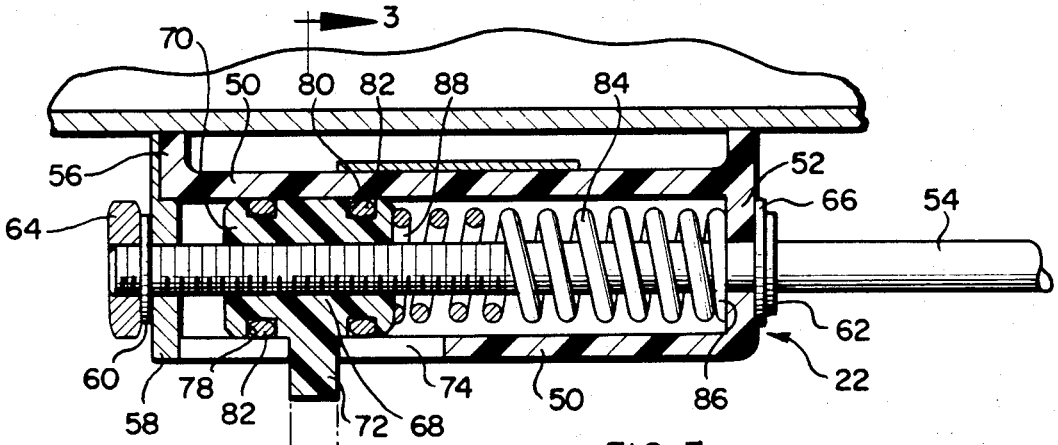
FIG. 2 is a sectional view of one of the switch point devices, taken along section lines 2—2 of FIG. 1.
Figure 3:
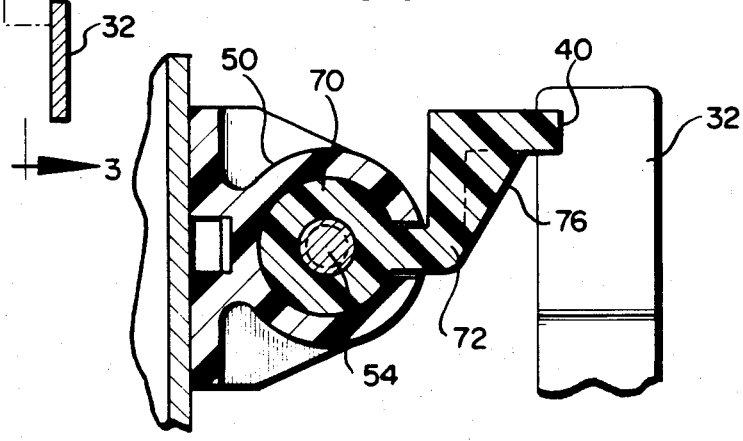
FIG. 3 is a sectional view taken along the section lines 3—3 of FIG. 2.

With reference to FIGS. 2 and 3, there is illustrated the construction details of the improved switch point devices 22, 24 in accordance with the principles of the present invention. FIGS. 2 and 3 illustrate the details of switch point unit 22, it being understood that a similar construction is provided for switch point device 24.

The switch point device includes a generally cylindrical housing 50 having one end 52 with a suitable aperture for receiving an elongated threaded shaft 54 which extends through the aperture and the housing and extends outwardly through an opposite housing end 56. Housing end cap 58 contains a suitable aperture for the threaded shaft. Respective clips 60, 62 captured in shaft 54 and a nut 64 maintain the components in position. A bearing mount 66 is provided at housing end 52 to rotatably mount the shaft 54. Suitable mounting means are provided, as shown in FIG. 1, for mounting switch devices 22, 24 to frame 12.

A movable post member 68, includes a generally cylindrical base portion 70 located within housing 50, and a post portion 72 extending through a suitably sized slot 74 in housing 50. As illustrated most clearly in FIGS. 1 and 3, post portion 72 extending from base portion 70 of movable post member 68 is formed in a dog-leg configuration so that set point 40 may be engaged by one end of lever arm 32 when the sensed process pressure has reached the low pressure switch point. An angle brace 76 is formed integrally with the post portion so as to strengthen the dog-leg post portion.

Base portion 70 is internally threaded so as to be threadably mounted on the threaded portion of shaft 54 as shown in FIG. 2. The low pressure set point is set by adjustably rotating knob 18 connected to threaded shaft 54. The outer diameter of base portion 70 is sized to conform to the inner diameter of housing 50. In addition, the outer surface of base portion 70 includes a circular slot 78 on one side of post portion 72 and a similar circular slot 80 on the other side of the post portion. Respective O-rings 82 are mounted in each slot. The O-rings enable the post member to be readily moved within the cylindrical housing in response to rotation of shaft 54 during setting of the desired switch point 40, and are sufficiently sized to be resiliently urged against the inner diameter of the cylindrical housing to substantially prevent movement of the post member after switch point setting. In addition, O-rings 82 absorb shock and vibration while maintaining the desired set position of the switch point.

A coil spring 84 has one end 86 seated against housing end 52 and another spring end 88 seated against base portion 70. As can be seen from FIG. 2, coil spring 84 surrounds threaded shaft 54 within housing 50. Spring 84 therefore biasingly urges base portion 70 outwardly, away from housing end 52, thereby maintaining base portion 70 in positive threadable engagement and loaded in one direction only against the threads in shaft 54. Thus, any dimensional differences in the components which would normally affect set point reliability is avoided, and the desired set point reliability is achieved without having to resort to high manufacturing tolerances during forming of the components.

The foregoing detailed description has been given for clearness of understanding only, and no unnecessary limitations should be understood therefrom, as modifications will be obvious to those skilled in the art.

What is claimed is:

1. In a fluid pressure sensor for monitoring a process pressure, including a Bourdon tube having an input end coupled to the process pressure and a moving output end responding to the process pressure to move in a first direction upon sensing an increasing pressure and in a second direction upon sensing a decreasing pressure, and switch point setting means for adjustably setting a pressure set point and adapted for engagement by the Bourdon tube moving output end when the pressure set point is reached, improved switch point setting means for maintaining a reliable pressure set point, said switch point setting means comprising:

a cylindrical housing;

an elongated threaded shaft rotatably mounted in said housing;

a movable post member including a base portion sized to substantially conform to the inner surface of said housing, said base portion threadably mounted on said elongated threaded shaft for longitudinal movement along said shaft during rotation thereof during setting of said pressure set point, and a post portion extending from the base portion and projecting from the housing for engagement by the Bourdon tube moving output end;

spring means within the housing for biasingly urging the base portion in positive threadable engagement with said shaft; and resilient means captured between said base portion and said housing inner surface for movement with said base portion;

said resilient means in resilient engaging contact with said housing inner surface to prevent undesired movement of said base portion with respect to said housing while enabling the base portion to be threadably moved by rotating said threaded shaft during setting of the desired pressure set point to overcome said resilient engaging contact of said resilient means with said housing inner surface.

2. The improvement of claim 1, wherein said base portion includes an annular slot and said resilient means includes at least one O-ring mounted within said annular slot.

3. The improvement of claim 1, wherein the housing includes an elongated slot, and said post portion extends from the base portion through said elongated slot.

4. The improvement of claim 3, wherein said base portion includes an annular slot on each side of the post portion, and said resilient means includes an O-ring respectively mounted within each of said annular slots.

5. The improvement of claim 1, wherein said spring means includes a coil spring surrounding a portion of the threaded shaft within the housing with opposite ends respectively seated against the housing and the base portion to biasingly urge the base portion in one longitudinal direction against the threaded shaft.

6. The improvement of claim 5, wherein said base portion includes an annular slot on each side of the post portion, and said resilient means includes a resilient O-ring member respectively mounted within each of said annular slots.

7. The improvement of claim 1, wherein said post portion is in the form of a dog-leg configuration.

* * * * *

UNITED STATES PATENT AND TRADEMARK OFFICE

CERTIFICATE OF CORRECTION

PATENT NO. : 4,485,727

DATED : December 4, 1984

INVENTOR(S) : David W. Shollenbarger

It is certified that error appears in the above-identified patent and that said Letters Patent is hereby corrected as shown below:

Column 4, line 57, after the words "housing with opposite" insert --spring--.

Signed and Sealed this

*Eleventh* Day of *June 1985*

[SEAL]

*Attest:*

DONALD J. QUIGG

*Attesting Officer*

*Acting Commissioner of Patents and Trademarks*